United States Patent [19]

Sloan, Jr.

[11] 4,146,147

[45] Mar. 27, 1979

[54] SELF-CONTAINED RADIATOR CAP

[75] Inventor: Paul H. Sloan, Jr., Louisville, Ky.

[73] Assignee: Stant Manufacturing Company, Inc., Connersville, Ind.

[21] Appl. No.: 850,153

[22] Filed: Nov. 10, 1977

Related U.S. Application Data

[63] Continuation of Ser. No. 706,526, Jul. 19, 1976, abandoned.

[51] Int. Cl.[2] ..... B65D 41/06

[52] U.S. Cl. ..... 220/203; 220/295; 220/301; 220/304; 220/303; 215/221

[58] Field of Search ..... 220/202, 203, 204, 205, 220/208, 209, 303, 301, 302, 295, 296, 297, 298, 300, 304, 293; 137/493; 215/356, 221, 357, 220, 222

[56] References Cited

U.S. PATENT DOCUMENTS

| | | | |
|---|---|---|---|
| 2,649,776 | 8/1953 | Konchan | 220/301 |
| 2,760,367 | 8/1956 | Stromberg | 220/203 |
| 3,209,746 | 10/1965 | Giuseppe | 220/203 |
| 3,216,608 | 11/1965 | McCormick | 220/295 |
| 3,415,410 | 12/1968 | Franchini | 220/203 |
| 3,463,346 | 8/1969 | Mitchell | 220/203 |
| 3,820,680 | 6/1974 | Friend | 220/203 |
| 3,913,783 | 10/1975 | Cooper | 220/301 |
| 4,020,970 | 5/1977 | Koscik et al. | 220/295 |

FOREIGN PATENT DOCUMENTS

| | | | |
|---|---|---|---|
| 1161323 | 8/1969 | United Kingdom | 215/222 |

*Primary Examiner*—William Price

*Assistant Examiner*—Joseph Man-Fu Moy

*Attorney, Agent, or Firm*—Jenkins, Coffey & Hyland

[57] ABSTRACT

A cap for closing an upwardly facing, neckless opening in a vehicle radiator comprises a shell defining a chamber within the cap. The shell includes an outer end disposed without the radiator when the cap is closing the opening and an inner end disposed within the radiator when the cap is closing the opening. A first venting passageway in the outer end of the shell connects the chamber to atmosphere, and a second venting passageway in the inner end of the shell connects the chamber to the radiator interior. An outwardly facing valve seat is disposed within the chamber and a pressure-vacuum valve is urged against the seat by a spring, the valve and spring being housed within the chamber. The seat is provided by an integral annular portion of the shell which extends peripherally and radially inwardly from an interior wall of the shell. A plurality of ears for engaging the radiator opening are disposed about the outer periphery of the shell and project radially outwardly therefrom. The projecting ears can be disposed adjacent the inner end of the shell, or can be disposed intermediate the inner and outer ends of the shell. The shell desirably is formed of molded plastic and is molded in two pieces. An outer piece includes the shell outer end and a portion of the shell side wall. An inner piece includes the shell inner end, a portion of the side wall, the engaging ears and the pressure-vacuum valve seat. The valve member and spring are placed between the two pieces which are then joined to assemble the cap.

5 Claims, 7 Drawing Figures

SELF-CONTAINED RADIATOR CAP

This is a continuation of my co-pending U.S. Pat. application Ser. No. 706,526, filed July 19, 1976, now abandoned, and assigned to the same assignee as this application.

This invention relates to radiator filler caps for sealed automobile cooling systems. More specifically, this invention relates to a cap for closing an automobile radiator which is not equipped with a neck or valve seat for a pressure cap.

Conventional radiator caps are designed to close the filler necks of radiators. Such filler necks are conventionally equipped with pressure valve seats at or near their lower extents. The neck and pressure valve seat are incorporated into the automobile radiator. Such caps may be designed to lock into the neck of the radiator. An example of such a cap can be found in U.S. Pat. No. 3,463,346, issued Aug. 26, 1969 to Mitchell and titled Radiator Filler Cap. Alternatively, caps for filling radiator neck openings can be the more conventional twist-to-remove type. Such a cap is illustrated in U.S. Pat. No. 2,732,971 issued Jan. 31, 1956 to Holmes et al and titled Radiator Caps. Reference is also made to U.S. Pat. Nos. 3,878,965; 3,373,894; 3,147,881; and 3,102,660 assigned to the assignee of this application and disclosing such twist-to-remove type radiator caps.

It is an object of the present invention to provide a radiator cap for sealing an opening in an upper surface of a radiator, which opening is provided with neither a neck nor a pressure valve seat. In this specification and in the appended claims, such a cap shall frequently be referred to as a "self-contained" radiator cap.

According to the invention, such a cap comprises a shell for defining a chamber within the cap. The shell includes an outer end disposed without the radiator when the cap is closing the opening and an inner end disposed within the radiator when the cap is closing the opening. A first venting passageway is provided in the outer end of the shell to provide communication between the chamber and the atmosphere while a second venting passageway is provided in the inner end of the shell to provide communication between the chamber and the radiator. A valve seat is disposed within the chamber and a valve member is urged against the seat normally to close the chamber between its outer and inner ends, the valve member and means for urging the valve member against the seat being housed within the chamber. Means for engaging the radiator opening are disposed about the outer periphery of the shell and extend outwardly therefrom. The engaging means can be disposed proximate the inner end of the shell, or can be disposed intermediate the inner and outer ends of the shell.

In one preferred embodiment, the shell, valve seat and valve member are all made of molded plastic. The shell includes a molded plastic outer portion which includes the shell outer end and a portion of the shell side wall and a molded plastic inner portion which includes the shell inner end, a portion of the side wall, the means for engaging the radiator opening, and the valve seat. Desirably, the valve seat is provided by an integral annular portion of the shell extending peripherally and radially inwardly into the chamber to divide the chamber into axially inner and outer spaces. The valve member and the means for urging the valve member against the seat, desirably a coiled spring, are assembled into the inner portion of the shell and the inner and outer portions are subsequently joined, e.g., by gluing, ultrasonic bonding or clamping.

Each of the molded plastic inner and outer portions includes means for defining a pressure-vacuum vent passage into the chamber defined within the shell. The valve member controls flow through the chamber between the interior of the radiator and the atmosphere.

The valve member desirably is a pressure valve member urged against the seat by the urging means and moved away from the seat by a predetermined superatmospheric pressure within the radiator. The pressure valve member further may include a smaller, co-axial vent opening normally closed by a vacuum valve member. The vacuum valve member is urged, e.g., by coil spring means, normally to a closing position against the pressure valve member. The vacuum valve member is responsive to a predetermined sub-atmospheric pressure within the radiator to move away from the pressure valve member to vent the radiator to atmosphere.

The invention may best be understood by referring to the following description and accompanying drawings which illustrate the invention. In the drawings.

Figure 1:
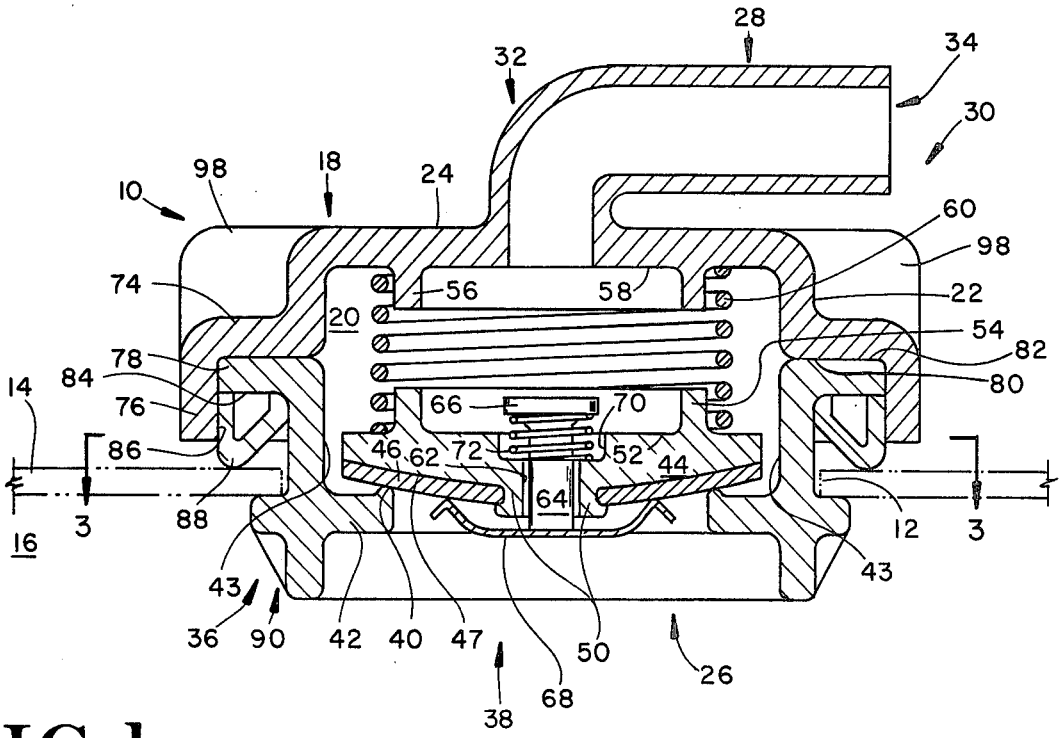
FIG. 1 is a vertical sectional view of a cap constructed in accordance with the present invention in place on a radiator.

In FIG. 1, the self-contained closure 10 for closing an upwardly facing opening 12 in an upper surface 14 of a radiator 16 is preferably formed from a molded plastic material. The closure 10 includes a shell 18 defining a chamber 20 within the closure. The shell 18 has a generally cylindrical outer side wall 22 and an outer end 24. Outer end 24 is disposed without the radiator 16 when closure 10 engages opening 12. The closure 10 also includes an inner end 26 which is disposed within radiator 16 when closure 10 engages opening 12. A tube 28 is molded into an upper portion 30 of closure 10. Tube 28 first extends vertically co-axially with shell 18, and then horizontally from a right angle bend 32 to provide, at the tube 28 outer end, a first pressure-vacuum venting opening 34 providing communication between the chamber 20 and the atmosphere.

A lower portion 36 of shell 18 includes, at inner end 26, a second pressure-vacuum venting opening 38 providing communication between the chamber 20 and the radiator 16 interior. Also defined adjacent the inner end 26 is an axially upwardly facing valve seat 40. Valve seat 40 is disposed within chamber 20 on an annular ridge 42 formed on interior wall 43 of lower portion 36. This valve seat divides the chamber 20 into inner and outer spaces. A valve member 44 having a generally circular horizontal cross section is disposed within chamber 20 normally to close against the valve seat 40. Valve member 44 includes a resilient sealing gasket 46 which covers the convex downwardly facing surface 47 of valve member 44. Gasket 46 is positioned on member 44 by a central, axially extending stem 48 which is headed at 50 to capture gasket 46 on valve member 44.

A generally flat, upwardly or axially outwardly extending surface 52 of valve member 44 includes a concentric annular ridge 54. A similar concentric annular ridge 56 is molded into the generally flat, downwardly or axially inwardly facing surface 58 of upper shell portion 30. Ridges 54, 56 capture and position a spring 60 within chamber 20. Spring 60 constitutes means for urging valve member 44 into closing engagement with valve seat 40 to prevent passage of fluids between pressure-vacuum vent openings 34, 38.

Stem 48 includes a central circular bore 62 through which is received a valve stem 64. At the upper end of valve stem 64 is a retaining head 66. At the lower end of stem 64 is a metal valve member 68. Directly beneath retaining head 66, a slight depression or retaining cup 70 is molded into valve member 44. A small spring 72 retained in cup 70 about stem 64 urges against head 66 normally to hold valve member 68 upwardly in closing relationship with gasket 46 of valve member 44.

On shell upper portion 30, the side wall 22 is formed to provide, near its downward extent, a peripherally and radially outwardly extending portion 74 having a downwardly or axially inwardly extending flange 76 at its outer extent. Lower portion 36 includes, at its upward or axially outward extent a radially outwardly extending flange 78. A downwardly facing surface 80 of portion 74 and an upwardly facing surface 82 of flange 78 are formed to engage one another matingly and sealingly. The two closure portions 30, 36 can be joined along the surfaces 80, 82, e.g., by gluing with a glue capable of withstanding substantial pressures and temperatures and hostile chemical environment. Of course, any number of techniques may be used to connect the outer and inner shell portions including ultrasonic bonding techniques and mechanical fastening or clamping techniques. The flange 76 extends axially inwardly a sufficient distance to define below an axially inwardly facing surface 84 of flange 78 a retaining lip 86.

Figure 3:
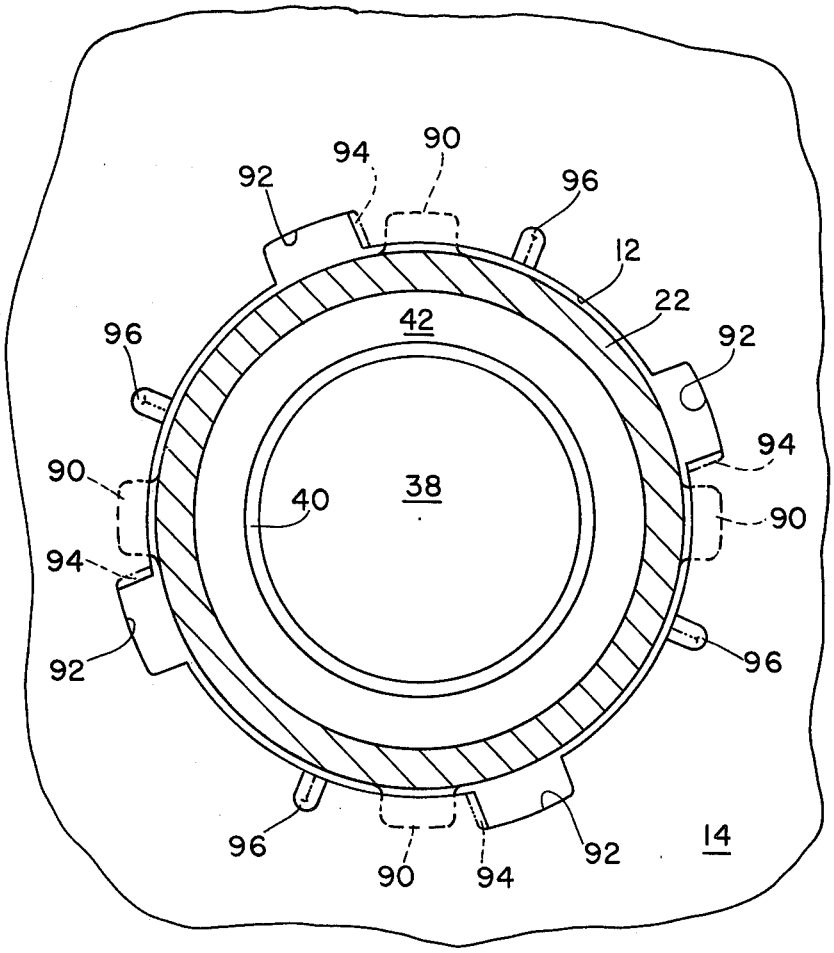
FIG. 3 is a sectional view of the cap of FIG. 1 taken along section lines 3—3 thereof.

The means for sealingly engaging closure 10 in the radiator opening 12 includes a resilient sealing gasket 88 captured between retaining lip 86 and the side wall 22 of lower portion 36. Surface 84 provides a gasket seat. Retaining gasket 88 is an annular gasket and illustratively has a generally trapezoidal radial cross section. The means for sealingly engaging the closure in the radiator opening also includes a plurality of cam locking ears 90. Cam locking ears 90 extend radially outwardly from the side wall 22 of lower portion 36 intermediate the outer and inner ends 24, 26, respectively, of closure 10. Preferably, and in the disclosed embodiment, ears 90 are situated along side wall 22 of lower portion 36 adjacent inner end 26. Lower portion 36 is preferably formed with four cam locking ears 90 (FIG. 3).

To close opening 12, closure 10 is projected axially to pass ears 90 through peripheral, radially extending slots 92 in opening 12. Closure 10 is urged axially inwardly, compressing gasket 88 against upper surface 14 of radiator 16. Closure 10 then is turned clockwise, urging ears 90 under stops 94. Closure 10 is released and is urged axially outwardly by compressed gasket 88. Ears 90 are captured between stops 94 and dimples 96 formed in the radiator top surface 14. Gasket 88 remains sufficiently compressed to seal closure 10 in opening 12.

To aid in turning closure 10, a pair of radially outwardly and axially outwardly extending handles 98 (FIG. 1) are molded into upper portion 30. Handles 98 aid the user in gripping the closure 10 either to close opening 12 or to remove the closure from the opening.

Figure 2:
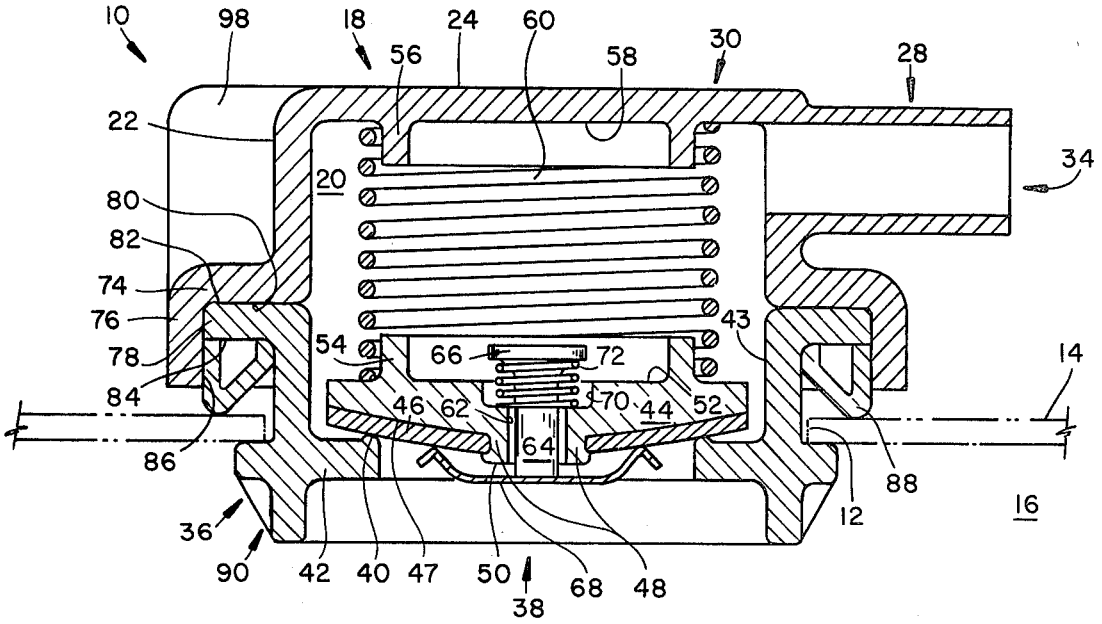
FIG. 2 is a vertical sectional view of an alternative detail of the cap of FIG. 1.

In FIG. 2, a detail of an alternative arrangement for pressure-vacuum venting opening 34 is illustrated. In this embodiment, tube 28 is formed to extend horizontally directly into the upper portion of chamber 20, i.e., above the valve seat 40. Tube 28 in this embodiment does not include the axially outwardly extending portion and right angle bend 32 illustrated in FIG. 1.

In the venting operation of the cap 10, valve member 44, gasket 46, and valve seat 40 cooperate to close the interior of radiator 16 until a predetermined superatmospheric pressure is reached therein. Then gasket 46 and the member 44 are urged upwardly against the pressure of spring 60 from valve seat 40 to vent this pressure through openings 34, 38. When a predetermined subatmospheric pressure prevails within radiator 16, the valve member 68 is urged downwardly against the force of spring 72 by the external (atmospheric) pressure within outer portion of chamber 20. Atmospheric pressure is available to valve member 68 because the diameter of bore 62 is somewhat larger than the diameter of stem 64. Movement downwardly of valve member 68 opens the interior of radiator 16 to the atmosphere, venting the vacuum within the radiator.

Referring now to FIGS. 4–7, those elements which perform the same or similar functions as in the embodiments of FIGS. 1–3 are identically numbered.

Figure 4:
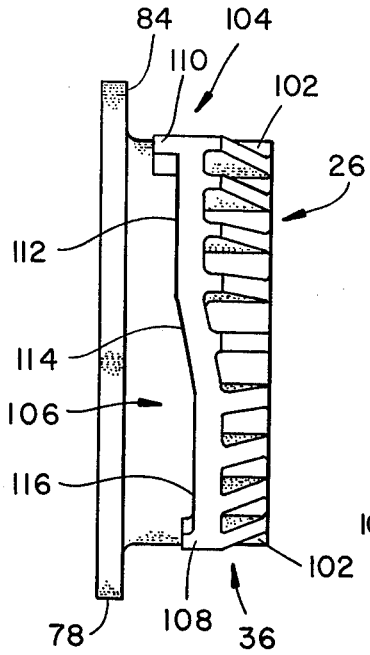
FIG. 4 is a side elevational view of an alternative shape of the cap axially inner portion.
Figure 5:
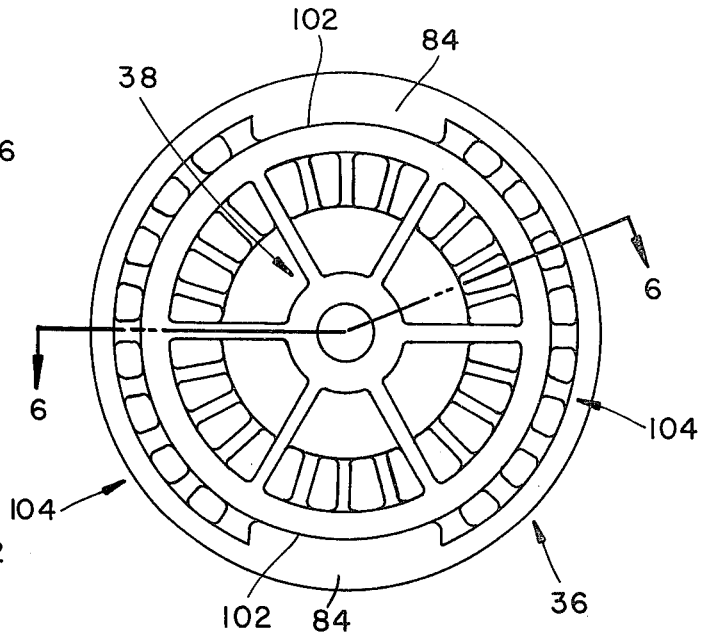
FIG. 5 is a bottom plan view of the cap axially inner portion of FIG. 4.
Figure 6:
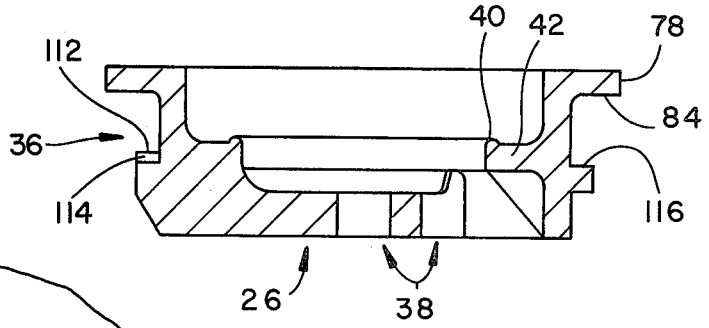
FIG. 6 is a sectional view of the cap of FIG. 5 taken generally along section lines 6—6 thereof.

An alternative shape for lower portion 36 of closure 10 is illustrated in FIGS. 4–6. This shape is provided to close an opening 12 such as that illustrated in FIG. 7. In such an opening 12, a plurality of tabs 100 project radially inwardly from the periphery of opening 12. Illustratively, two tabs 100 are provided. Radially and peripherally extending slots 92 are defined between tabs 100. An equal plurality of slots 102 (FIG. 5) are provided between the locking collar sections 104 formed adjacent the axially inner end 26 of lower portion 36.

Referring now to FIG. 4, an axially outwardly facing surface 106 of each locking collar portion 104 is terminated at its peripherally spaced apart ends by axially upwardly extending projections 108, 110. Each surface 106 is divided into three land areas. These are, respectively, a radiator-sealing land 112, a camming land 114, and a venting land 116.

Figure 7:
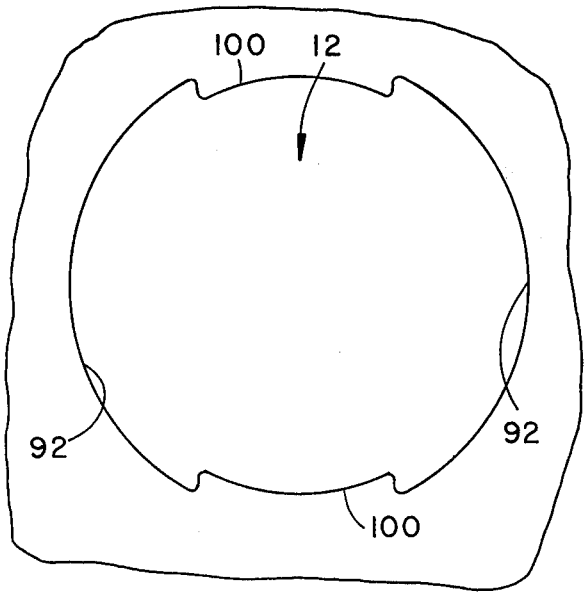
FIG. 7 is a top plan view of a radiator opening adapted to receive the cap axially inner portion of FIGS. 4–6.

Recalling that in an assembled cap employing lower portion 36 of FIGS. 4–5, a gasket such as gasket 88 of FIGS. 1–2 would be used, the operation of a cap 10 utilizing lower portion 36 of FIGS. 4–5 to close the opening 12 of FIG. 7 proceeds as follows. Lower portion 36 is oriented above opening 12 so that slots 102 align with tabs 100. Lower portion 36 is projected axially inwardly into opening 12. Sufficient force is applied axially so that upwardly directed projections 108 are axially inward from tabs 100. This force is required to compress gasket 88 slightly between surfaces 14, 84. The cap is then rotated several degrees about its axis so that tabs 100 overlie venting land 116. Continued rotation of the cap causes tabs 100 to cam up on lands 114, drawing lower portion 36 axially inwardly into radiator 16 and compressing gasket 88 further. Finally, tabs 100 rest fully upon land 112 and are stopped by axially upwardly directed projections 110. Radiator 16 is sealed.

To remove a cap utilizing such a lower portion 36, the cap is rotated in the opposite direction to move lands 112 from beneath tabs 100. Removal of tabs 100 to lands 114 causes the cap to cam axially outwardly sufficiently to relieve some of the compression from gasket 88. With tabs 100 overlying lands 116, a substantial portion of the working pressure within radiator 16 will be relieved as the radiator vents between its outer surface 14 and gasket 88. Slight axially inward force against the cap will allow tabs 100 to override projections 108. Tabs 100 can then be brought into registry with slots 102. The cap can then be removed.

There is thus presented a closure 10 for closing an opening 12 in a radiator 16. Importantly, opening 12 is not equipped with a neck or with the pressure valve seat with which radiator neck openings are conventionally provided. Rather, the pressure valve seat is included in the self-contained closure 10. A significant savings in the construction of radiators can result from manufacturing radiators without filler necks or pressure valve seats in them.

What is claimed is:

1. In a radiator having an upper wall including an upwardly facing outer planar surface and a downwardly facing inner planar surface with a filler aperture therethrough, said radiator being provided with no filler neck nor any depending wall surrounding the filler aperture, the outer and inner surfaces surrounding the filler aperture being substantially flat and parallel, the improvement wherein the filler aperture includes at least one radially and peripherally extending slot, and a self-contained closure for the filler aperture, the closure comprising a shell having axially outer and inner portions, the shell having at least one radially outwardly extending projection for movement axially through the slot in the radiator filler aperture, the shell further including an annular axially inwardly facing gasket seat axially outwardly from the projection, a gasket for sealing the filler aperture when the closure is projected axially into the filler aperture and the projection is passed axially through the slot and the closure is rotated upon its axis, the gasket being located on the closure between the seat and the projection, the shell further including a passageway for venting the radiator interior, and pressure-vacuum valve means for controlling the venting passageway, the radially outwardly extending projection includes first and second axially outwardly facing land portions joined by an inclined camming portion for camming the closure axially into and out of the radiator filler aperture by rotating the closure, a first stop adjacent the first land, the first stop preventing unintentional rotation of the closure to disengage the closure from the radiator filler aperture, and a second stop adjacent the second land for preventing rotation of the closure in the radiator filler aperture after the closure has reached sealing projection into the radiator filler aperture.

2. The improvement of claim 1 wherein the shell outer and inner portions define respectively axially outer and inner ends, the shell further including a side wall, each said outer and inner portion providing part of the shell side wall, the passageway being a generally cylindrical chamber defined within the side wall and between the outer and inner ends, means for defining an opening to atmosphere in the outer end and means for defining an opening to the radiator interior in the inner end, said valve means including a valve seat provided on an annular, radially inwardly extending wall projecting from the side wall into the chamber, and a valve member and means for urging said member against said seat, said valve member and urging means being disposed within the chamber.

3. The improvement of claim 1, wherein the shell outer portion includes an axially extending skirt for providing a radially inwardly facing wall for restraining said gasket against radially outward deformation when the closure is in closing engagement with the radiator filler aperture, the axially extending skirt being disposed radially outwardly from the gasket seat.

4. In combination, a radiator having an upper wall including an upwardly facing outer planar surface and a downwardly facing inner planar surface with a filler aperture therethrough, said radiator being provided with no filler neck nor any depending wall surrounding the filler aperture, the outer and inner surfaces surrounding the filler aperture being substantially flat and parallel, the filler aperture includes a plurality of slots, each having a peripheral edge and two radial edges, and a self-contained closure for the filler aperture, the closure comprising a shell having axially outer and inner portions, the shell having a plurality of radially outwardly extending projections for movement axially through respective slots in the radiator filler aperture, the shell further including an annular axially inwardly facing gasket seat axially outwardly from the projections, a gasket for sealing the filler aperture when the closure is projected axially into the filler aperture and the projections are passed axially through respective slots and the closure is rotated upon its axis, the gasket being located on the closure between the seat and the projections, the shell further including a passageway for venting the radiator interior, and pressure-vacuum valve means for controlling the venting passageway, each slot being formed to provide at one of its radial edges a radially and axially extending safety stop preventing unintentional rotation of the closure to disengage the closure from the radiator filler aperture, and a plurality of second stops provided in the substantially flat inner surface adjacent the aperture for preventing rotation of the closure in the radiator filler aperture when the closure is in sealing projection in the radiator filler aperture, each projection engaging one of the second stops when the closure is rotated in the aperture to move each projection in a direction away from its respective first stop.

5. The combination of claim 4 wherein each second stop comprises a dimple formed in the radiator top surface to project longitudinally of the axis of the aperture into the radiator.

* * * * *